US007197988B2

(12) United States Patent
Degen et al.

(10) Patent No.: US 7,197,988 B2
(45) Date of Patent: Apr. 3, 2007

(54) TABLE WITH DRAWER

(75) Inventors: Jin Degen, Xiamen (CN); Jin Shenghao, Xiamen (CN); Arvin Patel, Sunnyvale, CA (US)

(73) Assignee: Lifetime Products, Inc., Clearfield, UT (US)

( * ) Notice: Subject to any disclaimer, the term of this patent is extended or adjusted under 35 U.S.C. 154(b) by 118 days.

(21) Appl. No.: 10/726,797

(22) Filed: Dec. 3, 2003

(65) Prior Publication Data

US 2004/0194676 A1 Oct. 7, 2004

(30) Foreign Application Priority Data

Dec. 10, 2002 (CN) ..... 02 1 35871

(51) Int. Cl.
*A47B 67/00* (2006.01)

(52) U.S. Cl. ..... 108/26; 312/246

(58) Field of Classification Search ..... 108/25, 108/26, 901, 902; 312/246, 330.1, 350, 208.1, 312/194; 248/250, 248, 201, 298
See application file for complete search history.

(56) References Cited

U.S. PATENT DOCUMENTS 692,312 A * 2/1902 Laib ..... 108/25
830,532 A * 9/1906 Rozee ..... 108/11
2,158,726 A * 5/1939 Lindsay ..... 108/73
2,750,242 A * 6/1956 Viehmann ..... 108/83
2,754,167 A * 7/1956 Young ..... 312/285
4,140,355 A * 2/1979 Swain ..... 312/330.1
4,628,185 A * 12/1986 Norwood et al. ..... 219/386
4,887,536 A * 12/1989 Teichner ..... 108/35
5,121,681 A * 6/1992 Chang ..... 108/25
5,628,552 A * 5/1997 O'Barr ..... 312/330.1
5,909,713 A * 6/1999 Liaw ..... 108/119
5,909,934 A * 6/1999 McGraw ..... 312/223.3
5,997,118 A * 12/1999 McBrayer et al. ..... 312/334.44
6,015,053 A * 1/2000 Sheng ..... 211/188
6,056,378 A * 5/2000 Semon et al. ..... 312/246
D493,310 S * 7/2004 Ashby et al. ..... D6/511
6,877,826 B2 * 4/2005 Wood et al. ..... 312/205
2004/0255826 A1 * 12/2004 Ashby et al. ..... 108/26

* cited by examiner

*Primary Examiner*—Janet M. Wilkens
(74) *Attorney, Agent, or Firm*—Workman Nydegger

(57) ABSTRACT

A table includes a table top that is preferably constructed from blow molded plastic. The table top includes a top surface, a bottom surface and a pair of spaced apart generally L-shaped brackets. The generally L-shaped brackets can be attached to or integrally formed with the bottom surface of the table top, and the generally L-shaped brackets are preferably sized and configured to attach a drawer to the table top. In greater detail, the generally L-shaped brackets may have a vertical portion and a bottom portion that is sized and configured to support the drawer. Additionally, generally L-shaped angle irons may be connected to the brackets to reinforce the brackets or the angle irons may be used to form the bottom portion of the L-shaped bracket.

19 Claims, 4 Drawing Sheets

TABLE WITH DRAWER

CROSS-REFERENCE TO RELATED APPLICATIONS

This application claims priority to and benefit of Chinese Patent Application Serial No. 02135871.0, filed Dec. 10, 2002 and entitled "A Type of Folding Hollow-table top Table with Drawer," which is incorporated by reference in its entirety. This application is also related to co-pending U.S. patent application Ser. No. 10/727,073 filed Dec. 3, 2003, and entitled "Table top with drawer," now abandoned, which is incorporated by reference in its entirety.

BACKGROUND OF THE INVENTION

1. Field of the Invention

The present invention generally relates to furniture and, in particular, to a table with a drawer.

2. Description of Related Art

Conventional table tops are often constructed from fiberboard or particle board. Although such materials are widely available, these types of table tops often have little strength and are easily damaged or broken. In addition, the connections between the legs and the table tops are often not secure and they tend to loosen or break over time. If the table top is damaged or broken, it is often difficult or impossible to repair. Moreover, this type of table top, which is constructed from solid materials, is relatively heavy and difficult to move.

It is also known to construct table tops from plastic instead of fiberboard or particle board. Plastic table tops are generally easy to manufacture because they may require a relatively small amount of material to construct and the plastic table tops may be constructed with relatively simple manufacturing steps. Furthermore, the plastic table tops tend to be high in strength, light-weight, and easy to clean. Additionally, plastic table tops are often preferred by consumers because of there portability and ease of use.

Tables constructed with these conventional plastic table tops are often used for a variety of purposes and tasks. For example, people often place items on the table top such as pens, paper, erasers, needles, thread, chopsticks, knives and forks. After use, a person must place these items in a separate storage location and retrieve them again when needed. Alternatively, a person will place various items on the surface of the table top during use, but because the surface can be rather slippery or smooth, the items tend to roll off onto the ground, making it inconvenient for the user.

SUMMARY OF THE INVENTION

A need therefore exists for a table top that eliminates the above-described disadvantages and problems.

One aspect of the present invention is a table top with a drawer that is relatively simple in structure and design, and is easy to use.

Another aspect is a table with a table top constructed from plastic. Preferably the table top is constructed from blow-molded plastic, but the table top could also be constructed from injection molded plastic, extrusion molded plastic, compression molded plastic, etc.

A further aspect is a table with a table top including a top surface, a bottom surface, and a pair of spaced apart generally L-shaped brackets extending outwardly from the bottom surface of the table top. The brackets and the bottom surface of the table top preferably at least partially define a chamber. A drawer is preferably sized and configured to be slidably disposed in the chamber. A pair of legs may be connected to the table top to form the table.

Advantageously, the generally L-shaped brackets may be formed integrally with the table top to form a one-piece structure. Desirably each L-shaped bracket includes a vertical portion and a horizontal portion that may be formed integrally together. Alternatively, the vertical portion may be formed discretely or separately from the horizontal portion. In one embodiment, the horizontal portion is formed by a generally L-shaped angle iron having a vertical portion and a horizontal portion, and the vertical portion of the iron may be connected to the vertical portion of the L-shaped bracket such that the horizontal portion of the L-shaped iron is disposed transversely thereto. Alternatively, the L-shaped angle iron may be disposed in a corner of each L-shaped bracket.

Yet another aspect is a table with a lip that is formed around at least a portion of the outer periphery of the bottom surface of the table top. In addition, a notch may be formed in the lip at or near the location of the generally L-shaped brackets. Preferably, the space between the L-shaped brackets is substantially the same or less than the length of the notch. The table top may further include a recess formed around the periphery of the bottom surface of the table top such that the bottom surface is substantially level with the bottom portion of the outer lip. The table may also include a cross bar attached to an end of each of the table legs, and the cross bar may be disposed in the recess and pivotally attached to the table top.

A further aspect is a table that includes support assemblies generally disposed between the table legs. The support assemblies are preferably connected to the table top and the support assemblies may be sized and configured to assist in moving the table legs between the extended or use position and the folded or collapsed position.

A still further aspect is a table that provides supporting structures for a drawer which can be formed integrally with the table top. Significantly, this may reduce the amount of manufacturing time and materials required to construct the table. When the table is in use, common items such as pens, paper, erasers, needles, thread, chopsticks, knives, and forks can be placed in the drawer as needed. To increase both the resistance of the brackets to, abrasion and the ease with which the drawer can be opened and shut, the inner corners of the brackets may be provided with long L-shaped angle irons, if desired.

Yet another aspect is a table top with a drawer and a latch that can be used to secure the drawer in a locked position. Preferably, the latch can prevent the drawer from sliding out of the brackets when the table top is being moved. Moreover, the front-end panel of the drawer is preferably larger than the cross-section of the chamber so that the drawer is limited in its rearward placement. In addition, mechanical stops may also be placed at the inner end of L-shaped brackets. Therefore, the present invention is characterized by simple structure, reliable operation, ease of use, and a storage option.

These and other advantages and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings, in which.

DETAILED DESCRIPTION OF THE PREFERRED EMBODIMENTS

Figure 1:
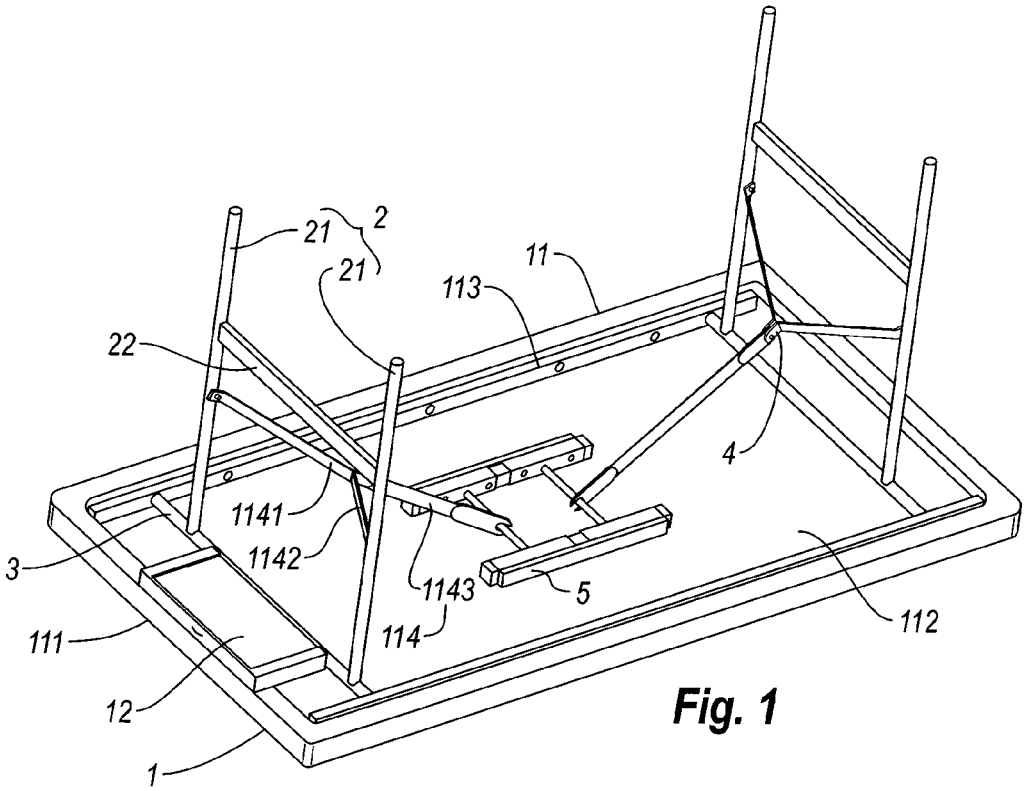
FIG. 1 is a perspective view of an exemplary embodiment of a table with a drawer, illustrating the table legs in an extended position.

With reference to FIG. 1, an exemplary table 1 is shown incorporating features of the present invention. The table 1 includes a table top 11 and a pair of legs 2. In one embodiment, the table top 11 is composed of a hollow, blow-molded plastic. Table top 11 is configured to receive a drawer 12. The top of the table top 11 is a work surface 111, and the bottom surface 112 provides various structures which allow the legs 2 and drawer 12 to be received by table top 11.

The bottom surface 112 is connected to legs 2 by two spaced apart side rails 113. A pair of support rods 114 supports the legs 2 when connected to table top 11. Each table leg 2 includes a pair of spaced apart leg members 21 connected by a support member 22. The leg members 21 are connected to a cross bar 3 which, in turn, is pivotally connected at opposing ends to the two side rails 113.

The support rod 114 is constructed from three rod elements 1141, 1142, and 1143. One end of the first rod element 1141 and one end of the second rod element 1142 are separately and pivotally connected to the lower part of the two leg members 21. The other ends are each pivotally connected together to the third rod element 1143. At this pivotal connection for these three rod elements 1141, 1142, and 1143, there is provided a slidable blocking ring 4 that can prevent the table members from folding. The other end of the third rod element 1143 is pivotally connected to the bottom surface 112 of the table top 11 by means of connecting structures 5.

A pair of brackets 115 is formed on bottom surface 112 of table top 11. The brackets 115 may begin at the edge of the table top 11 or be inset away from the edge of the table top. Brackets 115 extend inwardly toward the center of the table top 11. The brackets 115 and the bottom surface 112 of the table top 11 at least partially form a chamber 116. The drawer 12 can thus be slidably disposed in chamber 116 with the brackets 115 configured to hold and support drawer 12 on each side thereof.

In one embodiment, the brackets 115 are L-shaped having a vertical side 1151 and a horizontal portion. The horizontal portion provides a base on which the drawer 12 slidably rests when disposed in chamber 116. Preferably, the top ends of the two vertical sides 1151 are formed integrally with the bottom surface 112 of the table top 11 and can be formed during a blow-molding process. However, brackets 1115 may be discretely formed with table top 11.

While the drawings illustrate a pair of elongate brackets, it will be appreciated that each elongate bracket may be replaced with a plurality of discrete, aligned bracket section members placed at various distances along bottom surface 112 of table top 11. Furthermore, while the drawings show one set of brackets to accommodate one drawer, more than one set of brackets may be formed on the table top 11 to accommodate multiple drawers. Moreover, the brackets may be disposed on any side of the table top 11.

Drawer 12 includes a front-end panel 121, an opposing rear end panel (not shown), a bottom surface and a pair of side panels. The front panel 121 has a cross-section that is wider than a cross-section of the chamber 116 so that the drawer 12 is easily extracted from the chamber.

Figure 4:
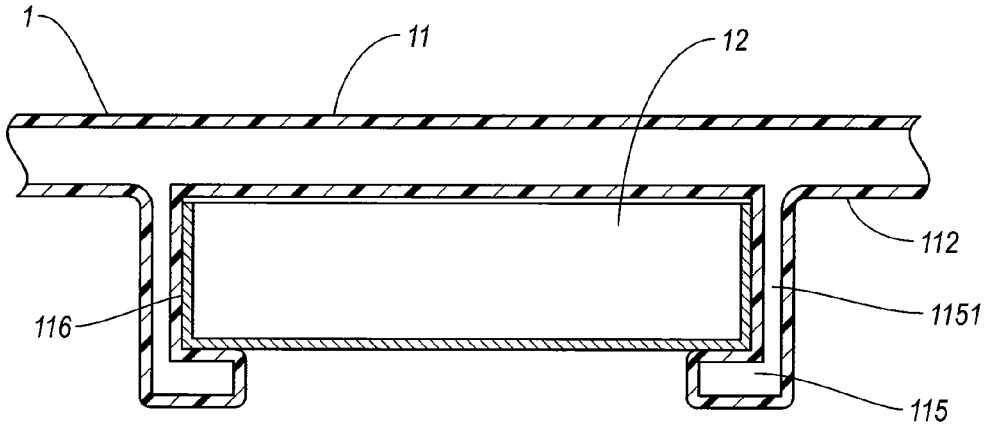
FIG. 4 is a partial cross-sectional view of an exemplary embodiment of a table with a drawer.

In view of the foregoing, the drawer 12 can be nested in the brackets 115 as shown in FIG. 4. Thus, without adding materials or work procedures, the structure can constitute a table having a drawer 12. When this table is in use, common items such as pens, paper, erasers, needles, thread, chopsticks, knives, and forks can be placed in the drawer 12 as needed.

Figure 5:
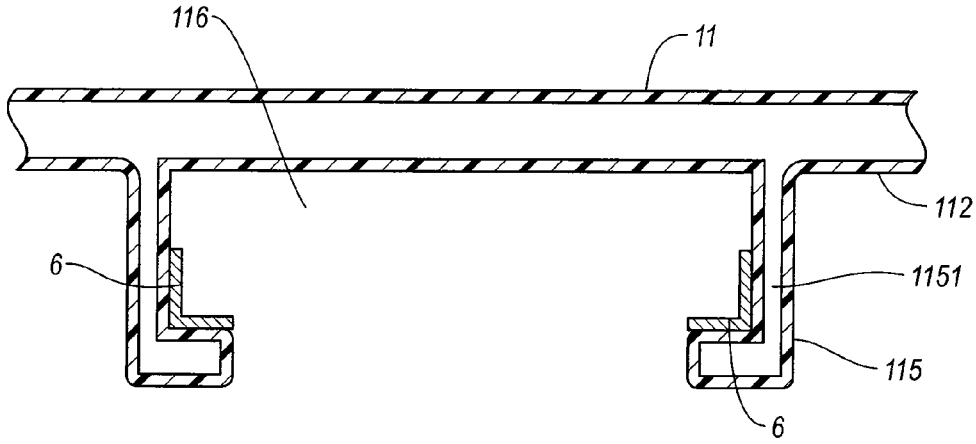
FIG. 5 is a partial cross-sectional view of another exemplary embodiment of a table with a drawer.

As shown in FIG. 5, in a second embodiment, to increase both the resistance of the brackets 115 to abrasion and the slidable engagement with drawer 12, the inner corners of the brackets 115 are provided with L-shaped angle iron 6.

Figure 6:
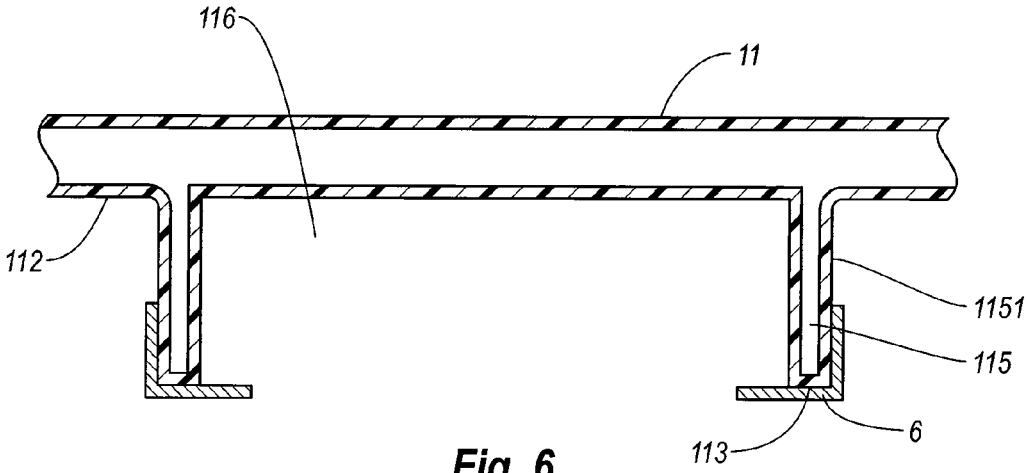
FIG. 6 is a partial cross-sectional view of yet another exemplary embodiment of a table with a drawer.

As shown in FIG. 6, a third embodiment includes a pair of parallel brackets 115. The tops of the two vertical sides 1151 form an integral whole with the bottom surface 112 of the table top 11. In this embodiment, the L-shaped angle irons 6 are attached to the vertical portion of brackets 115 to form the horizontal portion of the bracket. Thus, the horizontal portion can be formed discretely from the vertical side 1151.

Figure 2:
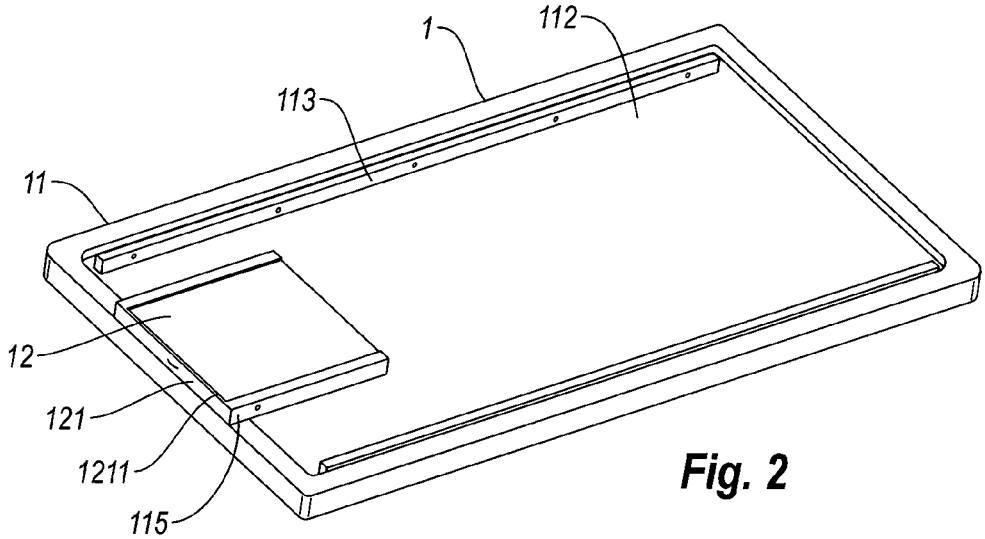
FIG. 2 is a perspective view of a portion of the table shown in FIG. 1, illustrating the drawer in a closed position.
Figure 3:
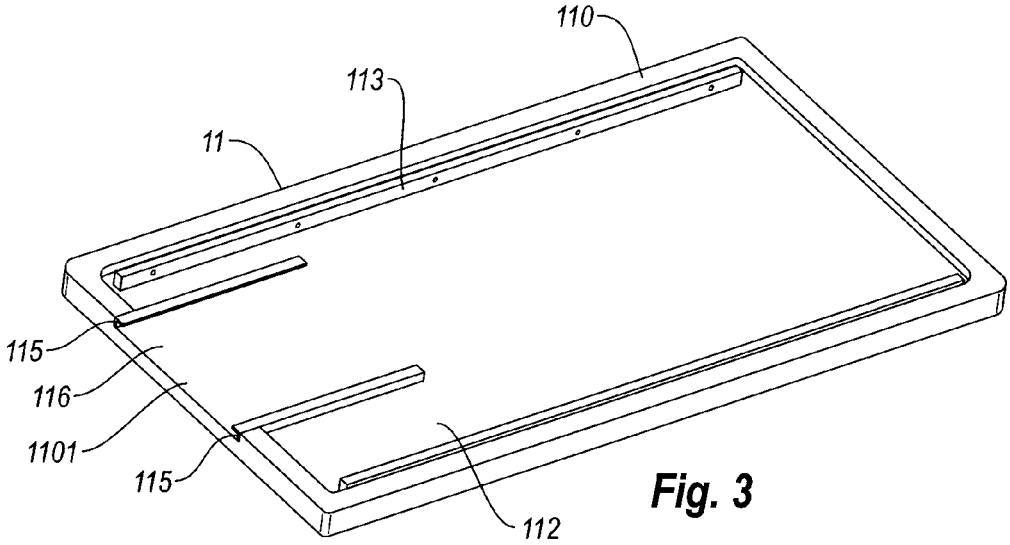
FIG. 3 is a perspective view of the portion of the table top shown in FIG. 2, illustrating the drawer removed from the table top.

In some embodiments, the height of the bottom surface 112 of table top 11 may vary. As shown in FIGS. 2 through 4, the bottom surface 112 includes a lip 110 formed on at least a portion of the outer periphery thereof. In this embodiment, the bottom surface 112 is not level with the bottom portion of lip 110 such that a notch 1101 must be formed in the lip so that the lip does not impede a drawer 12 from being placed in brackets 115. In this embodiment, the space between brackets 115 may be substantially the same as or smaller than the length of the notch 1101.

Figure 7:
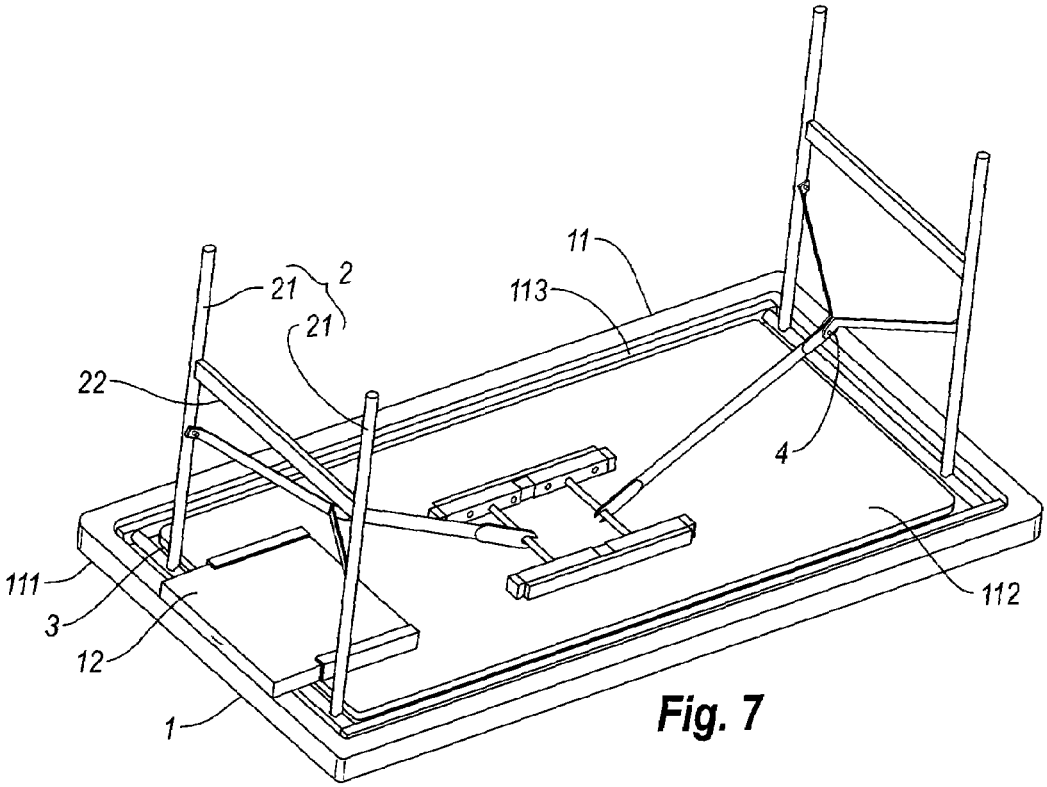
FIG. 7 is a perspective view of still another exemplary embodiment of a table with a drawer, illustrating the table legs in an extended position.
Figure 8:
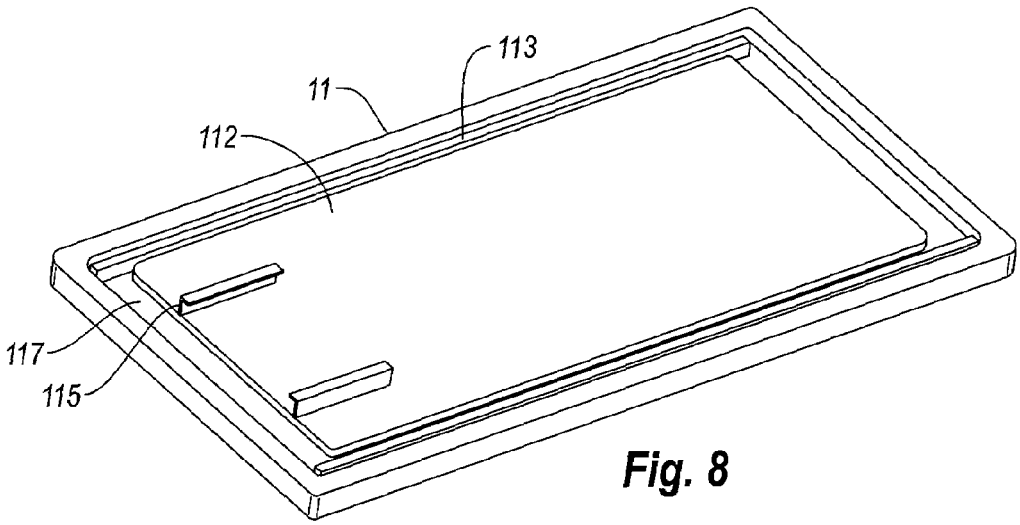
FIG. 8 is a perspective view of the portion of the table shown in FIG. 7, illustrating the table top and the drawer removed from the table top.

Alternatively, as shown in FIGS. 7 and 8, the table top 11 includes a recess 117 formed around the periphery thereof such that the bottom surface 112 of the table top is level with the bottom portion of the lip 110. As such, the lip 110 does not impede the placement of a drawer 12 in brackets 115. In this particular embodiment, the recess 117 provides a space to receive the side rails 113 and cross bar 3 that connects the legs 2 to the table top 11. Advantageously, this hides the side rails 113 and cross bar 3 from view when the table is set upright. When cross bar 3 is disposed in recess 117, the rotation of the cross bar 3 does not interfere with the opening and shutting of the drawer 12. To facilitate installation of the cross bar 3, the brackets 115 do not cross the recess 117.

Additionally, in any of the above embodiments, a mechanical stop can be provided at the inside end of the brackets 115 to restrict the distance that the drawer 12 can move. Furthermore, a latch (not shown) may be provided between the drawer 12 and the table top 111 to prevent the drawer from falling out of the brackets 115 when the table is being moved.

While reference is made in the figures of a folding table, it is appreciated that the features of the present invention may be incorporated on any support structure, whether configured to fold or not. For example, the table top 11 and drawer 12 configuration may be incorporated on any large utility table, smaller personal tables or end tables, shelving structures, and the like.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A table comprising:

a plastic table top comprising:

a top portion;

a bottom portion including a generally planar section; and a pair of spaced apart generally L-shaped brackets extending outwardly from the generally planar section of the bottom portion of the table top, each bracket of the pair of generally L-shaped brackets including a generally vertical portion extending beyond the bottom portion of the table top and a generally horizontal portion, the generally vertical portion including a generally parallel inner surface and outer surface, the generally horizontal portion including a generally parallel upper surface and lower surface, the pair of generally L-shaped brackets being distinct structures from other portions of the table top, at least a portion of the generally L-shaped brackets being constructed from plastic and being integrally formed with the table top as part of a unitary, one-piece structure, the portion of the generally L-shaped brackets constructed from plastic including a hollow interior portion at least partially disposed between the generally parallel inner surface and outer surface of the generally vertical portion, the brackets and the bottom portion of the table top at least partially defining a chamber;

a drawer that is sized and configured to be slidably disposed in the chamber and movable between a retracted position and an extended position; and a pair of legs connected to the table top.

2. The table as recited in claim 1, wherein the entire generally L-shaped brackets are formed integrally with the plastic table top.

3. The table as recited in claim 1, wherein each generally L-shaped bracket comprises a vertical portion and a horizontal portion formed integrally together.

4. The table as recited in claim 1, wherein each generally L-shaped bracket comprises a vertical portion and a discrete horizontal portion attached together.

5. The table as recited in claim 4, wherein the horizontal portion is formed by a generally L-shaped angle iron having a vertical portion and a horizontal portion, the vertical portion of the iron being connected to the vertical portion of the generally L-shaped bracket such that the horizontal portion of the generally L-shaped iron is disposed transversely thereto.

6. The table as recited in claim 1, further comprising a generally L-shaped angle iron disposed in a corner of each generally L-shaped bracket.

7. The table as recited in claim 1, further comprising a lip formed around at least a portion of the outer periphery of the bottom surface of the table top.

8. The table as recited in claim 7, further comprising a notch formed in the lip at the location of the generally L-shaped brackets, the space between the generally L-shaped brackets being substantially the same or less than the length of the notch.

9. The table as recited in claim 7, further comprising:

a recess formed around the periphery of the bottom surface of the table top such that the bottom surface is substantially level with the bottom portion of the outer lip; and a cross bar attached to an end of each of the table legs, wherein the cross bar is disposed in the recess and pivotally attached to the table top.

10. The table as recited in claim 1, wherein at least a portion of the generally L-shaped brackets form at least a portion of a base and at least a portion of the base is sized and configured to support the drawer.

11. A table comprising:

a table top constructed from blow-molded plastic, the table top including an upper portion, a lower portion and a hollow interior portion formed during the blow-molding process;

a drawer movable between a retracted position and an extended position relative to the table top;

one or more receiving portions integrally formed in the table top as part of a unitary, one-piece structure, the receiving portions including a hollow interior portion that is formed during the blow-molding process, the receiving portions being sized and configured to receive at least a portion of the drawer and allow the drawer to move between the retracted position and the extended position; and one or more legs that are sized and configured to support the table top above a surface;

wherein the one or more receiving portions form at least a portion of a base and at least a portion of the base is sized and configured to support the drawer.

12. The table as recited in claim 11, wherein each of the one or more receiving portions include at least one lateral portion.

13. The table as recited in claim 11, wherein the base includes a hollow interior portion that is integrally formed with the table top as part of a unitary, one-piece construction during the blow-molding process.

14. The table as recited in claim 11, further comprising one or more brackets attached to the one or more receiving portions.

15. A table comprising:

a table top constructed from blow-molded plastic and including an upper portion, a bottom portion and a hollow interior portion that is formed during the blow-molding process;

one or more legs connected to the table top;

a drawer movable between a retracted position and an extended position relative to the table top;

a first generally L-shaped bracket extending outwardly from the bottom portion of the table top, the first generally L-shaped bracket being integrally formed with the table top as part of a unitary, one-piece structure, the first generally L-shaped bracket including a hollow interior portion that is formed during the blow-molding process, the first generally L-shaped bracket including a lateral portion and a bottom portion, the entire first generally L-shaped bracket being formed integrally with the plastic table top during the blow-molding process, the first generally L-shaped bracket being sized and configured to allow the drawer to move between the retracted position and the extended position; and a second generally L-shaped bracket extending outwardly from the bottom portion of the table top, the second generally L-shaped bracket being integrally formed with the table top as part of a unitary, one-piece structure, the second generally L-shaped bracket including a hollow interior portion that is formed during the blow-molding process, the second generally L-shaped bracket including a lateral portion and a bottom portion, the entire second generally L-shaped bracket being formed integrally with the plastic table top during the blow-molding process, the second generally L-shaped bracket being sized and configured to allow the drawer to move between the retracted position and the extended position.

16. A table comprising:

a plastic table top comprising:

a top portion;

a bottom portion including a generally planar section; and a pair of spaced apart generally L-shaped brackets extending outwardly from the generally planar section of the bottom portion of the table top, the pair of generally L-shaped brackets being discrete structures from other portions of the table top, at least a portion of the generally L-shaped brackets being constructed from plastic and being integrally formed with the table top as part of a unitary, one-piece structure, the brackets and the bottom portion of the plastic table top at least partially defining a chamber;

a drawer that is sized and configured to be slidably disposed in the chamber and movable between a retracted position and an extended position; and a pair of legs connected to the table top;

wherein each generally L-shaped bracket comprises a vertical portion and a discrete horizontal portion attached together.

17. The table as recited in claim 16, further comprising a generally L-shaped angle iron having a vertical portion and a horizontal portion connected to the generally L-shaped bracket.

18. A table comprising:

a plastic table top comprising:

a top portion;

a bottom portion; and a pair of spaced apart generally L-shaped brackets extending outwardly from the bottom portion of the table top, at least a portion of the generally L-shaped brackets being constructed from plastic and being integrally formed with the table top as part of a unitary, one-piece structure, the brackets and the bottom portion at least partially defining a chamber;

a drawer that is sized and configured to be slidably disposed in the chamber and movable between a retracted position and an extended position;

a pair of legs connected to the table top; and a generally L-shaped angle iron disposed in a corner of each generally L-shaped bracket.

19. A table comprising:

a plastic table top comprising:

a top portion;

a bottom portion; and a pair of spaced apart generally L-shaped brackets extending outwardly from the bottom portion of the table top, at least a portion of the generally L-shaped brackets being constructed from plastic and being integrally formed with the table top as part of a unitary, one-piece structure, the brackets and the bottom portion at least partially defining a chamber;

a drawer that is sized and configured to be slidably disposed in the chamber and movable between a retracted position and an extended position;

a pair of legs connected to the table top;

a lip formed around at least a portion of the outer periphery of the bottom surface of the table top;

a notch formed in the lip at the location of the generally L-shaped brackets, the space between the generally L-shaped brackets being substantially the same or less than the length of the notch;

a recess formed around the periphery of the bottom surface of the table top such that the bottom surface is substantially level with the bottom portion of the outer lip; and a cross bar attached to an end of each of the table legs, wherein the cross bar is disposed in the recess and pivotally attached to the table top.

* * * * *

UNITED STATES PATENT AND TRADEMARK OFFICE

CERTIFICATE OF CORRECTION

PATENT NO. : 7,197,988 B2
APPLICATION NO. : 10/726797
DATED : April 3, 2007
INVENTOR(S) : Degen et al.

It is certified that error appears in the above-identified patent and that said Letters Patent is hereby corrected as shown below:

Column 1
Line 39, change “there” to --their--

Column 4
Line 10, change “1115” to --115--

Signed and Sealed this

Sixteenth Day of October, 2007

JON W. DUDAS
*Director of the United States Patent and Trademark Office*